US007996954B2

(12) United States Patent
Lee et al.

(10) Patent No.: US 7,996,954 B2
(45) **Date of Patent: *Aug. 16, 2011**

(54) PATH-CONVERSION VALVE ASSEMBLY FOR VACUUM CLEANER

(75) Inventors: Dong-yun Lee, Gwangju (KR); Tae-gwang Kim, Incheon (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 913 days.

This patent is subject to a terminal disclaimer.

(21) Appl. No.: 11/199,173

(22) Filed: Aug. 9, 2005

(65) Prior Publication Data

US 2006/0230572 A1 Oct. 19, 2006

(30) Foreign Application Priority Data

Apr. 13, 2005 (KR) ..... 10-2005-0030760

(51) Int. Cl.

| | |
|---|---|
| ***A47L 5/00*** | (2006.01) |
| ***A47L 9/00*** | (2006.01) |
| ***A47L 9/10*** | (2006.01) |
| ***A47L 9/20*** | (2006.01) |
| ***A47L 7/00*** | (2006.01) |

(52) U.S. Cl. ..... 15/334; 15/351; 15/320

(58) Field of Classification Search ..... 15/334, 15/351, 320

See application file for complete search history.

(56) References Cited

U.S. PATENT DOCUMENTS

| | | | | |
|---|---|---|---|---|
| 3,088,484 | A * | 5/1963 | Marsh | 137/360 |
| 3,565,103 | A * | 2/1971 | Maselek | 137/360 |
| 3,570,809 | A * | 3/1971 | Stuy | 251/149.9 |
| 3,701,427 | A * | 10/1972 | Howard | 210/167.1 |
| 3,750,222 | A * | 8/1973 | Johnson | 15/416 |
| 4,333,203 | A * | 6/1982 | Yonkers | 15/321 |
| 5,355,549 | A * | 10/1994 | Steinberg et al. | 15/334 |
| 5,477,586 | A | 12/1995 | Jacobs et al. | |
| 5,697,120 | A * | 12/1997 | Robinson | 15/321 |
| 5,732,439 | A | 3/1998 | Cipolla | |
| 6,108,860 | A * | 8/2000 | Crouser et al. | 15/321 |
| 6,536,074 | B2 | 3/2003 | Boles et al. | |
| 6,572,078 | B1 * | 6/2003 | Thomson et al. | 251/162 |
| 6,920,665 | B2 * | 7/2005 | Tucker | 15/334 |
| 7,231,687 | B2 * | 6/2007 | Rew et al. | 15/330 |
| 7,367,081 | B2 * | 5/2008 | O'Neal | 15/320 |
| 7,555,810 | B2 * | 7/2009 | Pullins et al. | 15/331 |
| 2003/0024068 | A1 | 2/2003 | Tucker | |
| 2004/0194247 | A1 | 10/2004 | Macleod et al. | |

FOREIGN PATENT DOCUMENTS

| | | | |
|---|---|---|---|
| EP | 1464267 | A2 | 10/2004 |

* cited by examiner

*Primary Examiner* — Lee D Wilson
*Assistant Examiner* — Alvin J Grant
(74) *Attorney, Agent, or Firm* — Blank Rome LLP

(57) ABSTRACT

A path-conversion valve assembly for a vacuum cleaner comprises a valve member rotatably mounted in an air path formed in a cleaner of a vacuum cleaner which includes a socket for receiving a hose nozzle, and a resilient member mounted in the air path to resiliently press the rotating valve member in an opposite direction to the rotating direction of the valve member.

6 Claims, 5 Drawing Sheets

PATH-CONVERSION VALVE ASSEMBLY FOR VACUUM CLEANER

This application claims benefit under 35 U.S.C. §119(a) of Korean Patent Application No. 2005-30760, filed Apr. 13, 2005, the entire contents of which are incorporated herein by reference.

BACKGROUND OF THE INVENTION

1. Field of the Invention

The present invention relates generally to the field of vacuum cleaners, and in some embodiments, to a path-conversion valve assembly for a vacuum cleaner.

2. Description of the Related Art

In the field of upright-type vacuum cleaners, a path-conversion valve assembly has already been widely used, which diverts a path for drawing in dust-laden air. In particular, an automatic path-conversion valve assembly controls the air path so that a vacuum force is transmitted to a hose when a main body of the vacuum cleaner is in an upright posture to clean an irregular surface such as a curtain (hereinbelow, referred to as 'hose mode'), and to a brush assembly when the main body is bent to clean an even surface such as a floor (hereinbelow, referred to as 'brush mode').

Examples of path-conversion valve assemblies that open and close an air-intake path formed in a brush assembly are disclosed in U.S. Pat. Nos. 5,732,439 and 6,536,074. Additionally, U.S. Pat. No. 5,477,586 discloses a path-conversion valve assembly for diverting an air path depending on whether an extension nozzle is connected to a socket formed at one side of the main body. However, the foregoing conventional path-conversion valve assemblies generally have complicated structures, thereby increasing manufacturing costs and requiring additional maintenance.

SUMMARY OF THE INVENTION

It is to be understood that both the following summary and the detailed description are exemplary and explanatory and are intended to provide further explanation of the invention as claimed. Neither the summary nor the description that follows is intended to define or limit the scope of the invention to the particular features mentioned in the summary or in the description.

In certain embodiments, the present invention may solve one or more of the above problems and/or disadvantages. In some embodiments, the invention also provides one or more of the advantages described below. Accordingly, in an embodiment, a path-conversion valve assembly enables convenient conversion of an air path in a vacuum cleaner.

In certain disclosed embodiments, a path-conversion valve assembly having a simple structure is provided.

In an exemplary embodiment, a path-conversion valve assembly for a vacuum cleaner comprises a valve member rotatably mounted in an air path formed in a main body of a vacuum cleaner which includes a socket for safekeeping a hose nozzle, and a resilient member mounted in the air path to resiliently press the rotating valve member in an opposite direction to the rotating direction of the valve member.

In exemplary embodiments, the path-conversion valve assembly comprises a first hook part formed at the valve member to catch one side of the resilient member; and a second hook part formed at the air path to catch the other side of the resilient member. The valve member may include a projection, and the air path includes a projection groove for insertion of the projection.

In an embodiment, the valve member comprises a duct part having a passage and an opening for air to flow therethrough; and a protrusion part slantingly formed on an outer circumference of the duct part.

In further embodiments, a path-conversion valve assembly for a vacuum cleaner comprises a valve member rotatably mounted at an intersection of first to fourth ducts, the first duct fluidly communicated with a vacuum source for generating a suction force, the second duct fluidly communicated with a hose connector, the third duct connected to an air inlet of a brush assembly and the fourth duct mounting a hose nozzle.

In an embodiment, the valve member comprises a duct part having a passage which keeps the first and the third ducts in fluid communication with each other all the time, and an opening which brings the first and the second ducts into fluid communication with each other selectively; and a protrusion part slantingly formed on an outer circumference of the duct part and resiliently pressed by the hose nozzle as the hose nozzle is inserted in the fourth duct.

The valve member may be rotated by the resilient member upon separation of the hose nozzle from the fourth duct and thereby brings the first and the second ducts into fluid communication with each other.

BRIEF DESCRIPTION OF THE DRAWING FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE EXEMPLARY EMBODIMENTS

Figure 1:
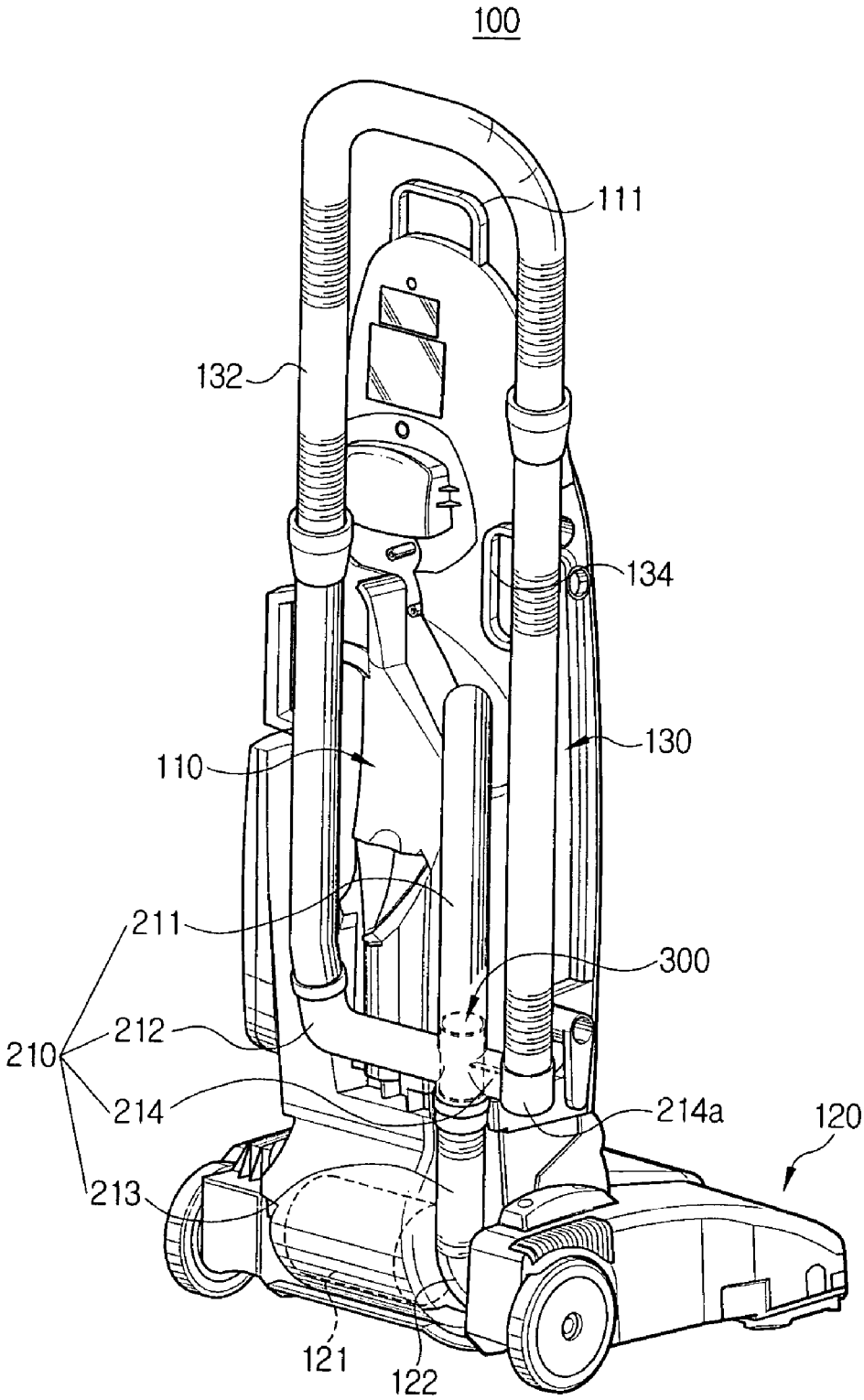
FIG. 1 is a perspective view of an upright-type vacuum cleaner applying a path-conversion valve assembly according to an embodiment of the present invention.

The present invention will now be explained in terms of exemplary embodiments. This specification discloses one or more embodiments that incorporate the features of this invention. The embodiment(s) described, and references in the specification to "one embodiment", "an embodiment", "an example embodiment", etc., indicate that the embodiment(s) described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, persons skilled in the art may effect such feature, structure, or characteristic in connection with other embodiments whether or not explicitly described.

In the following description, similar drawing reference numerals may be used for the same elements even in different drawings. The embodiments described, and their detailed construction and elements, are merely provided to assist in a comprehensive understanding of the invention. Thus, it is apparent that the present invention can be carried out in a variety of ways, and does not require any of the specific features described herein. Also, well-known functions or constructions are not described in detail since they would obscure the invention with unnecessary detail.

FIG. 1 is a perspective view of an upright-type vacuum cleaner employing a path-conversion valve assembly according to an embodiment of the present invention. Referring to FIG. 1, an upright-type vacuum cleaner 100 comprises a cleaner body 110, a brush assembly 120, a hose 130, a vacuum source 121, an air path 210 and a path-conversion valve assembly 300.

The cleaner body 110 has a dust receptacle (not shown) therein, a cleaner handle 111 at an upper part thereof, for being grasped by a user to move the vacuum cleaner 100, and an air path 210 at a rear side thereof. The cleaner body 110 is hinged to a brush assembly 120.

The brush assembly 120 is disposed at a lower part of the cleaner body 110 and has an air inlet (not shown) for drawing in dust on a surface being cleaned, such as carpet. The brush assembly 120 comprises the vacuum source 121 in this embodiment; however, the vacuum source 121 may be mounted in the cleaner body 110.

The hose 130 is for cleaning irregular surfaces that are difficult to clean using the brush assembly 120. These irregular surfaces may include but are not limited to stairs, a shelf or a curtain. The hose 130 may be integrally formed with the air path 210 or may be formed as a detachable accessory hose. The hose 130 comprises a connector 131 (FIG. 2) and a hose nozzle 133 (FIG. 2) which are connected to the path-conversion valve assembly 300, a connection tube 132 for interconnecting the connector 131 and the hose nozzle 133, and a hose handle 134 by which a user may grasp hose 130.

Figure 2:
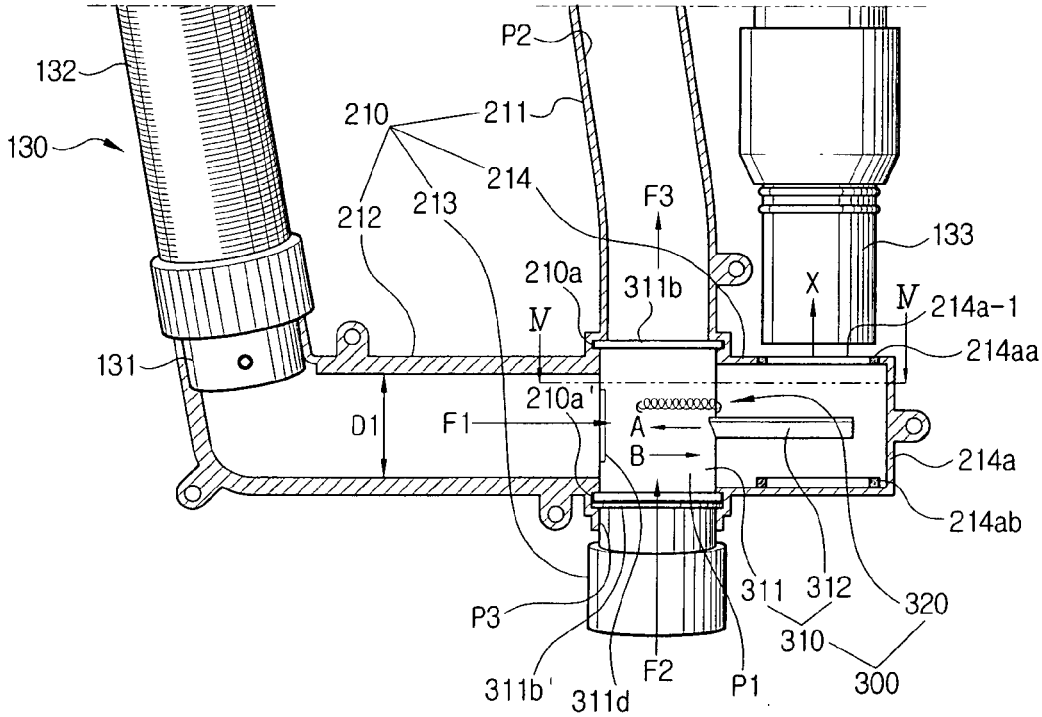
FIG. 2 is a partially sectioned view of an air path in which a valve member of the path-conversion valve assembly is disposed in a first position.

Referring to FIGS. 1 and 2, the air path 210 comprises first through fourth ducts 211 through 214.

The first duct 211 has a predetermined length upward to be connected to the vacuum source 121. The first duct 211 may be connected to the vacuum source 121 directly or through another connection means such as a flexible hose.

The second duct 212 has a predetermined length to the left to be connected to the connector 131 of the hose 130. The connector 131 of the hose 130 is connected with the second duct 212; for example, connector 131 may be inserted into the second duct 212.

The third duct 213 has a predetermined downward length and is connected to a connection pipe 122 of the brush assembly 120. The connection pipe 122 of the brush assembly 120 may be directly connected to the third duct 213 or connected to the third duct 213 through another connection means such as the flexible hose. Alternatively, the third duct 213 can be extended and directly connected to the brush assembly 120 without the connection pipe 122.

The fourth duct 214 has a predetermined length for connection to the hose nozzle 133. A socket 214*a* for connection with the hose nozzle 133 is formed at one side of the fourth duct 214. The socket 214*a* is a part of the fourth duct 214, and an entrance 214*a*-1 of the socket 214*a* is sealed by insertion of the hose nozzle 133 into the socket 214*a*.

Annular support bands 214*aa* and 214*ab*, having a smaller diameter than an outer diameter of the hose nozzle 133, are disposed around the socket 214*a*. Hose nozzle 133 is held in socket 214*a* by friction between hose nozzle 133 and support bands 214*aa* and 214*ab*. Support bands 214*aa* and 214*ab* are preferably made of a resilient medium such as rubber having a high elasticity and frictional coefficient.

Referring to FIG. 2, the path-conversion valve assembly 300 operates so that in a brush mode, suction force is transmitted only to the brush assembly 120 for cleaning an even surface such as floor, and in a hose mode, suction is transmitted to both the brush assembly 120 and the hose 130 for cleaning irregular surfaces such as a curtain using an accessory. The path-conversion valve assembly 300 is disposed in the air path 210 and comprises a valve member 310 and a resilient member 320.

The valve member 310 is mounted at an intersection of the first to the fourth ducts 211 to 214 to be rotatable in an arrowed direction A or B. The valve member 310 comprises a duct part 311 and a protrusion part 312.

Figure 4:
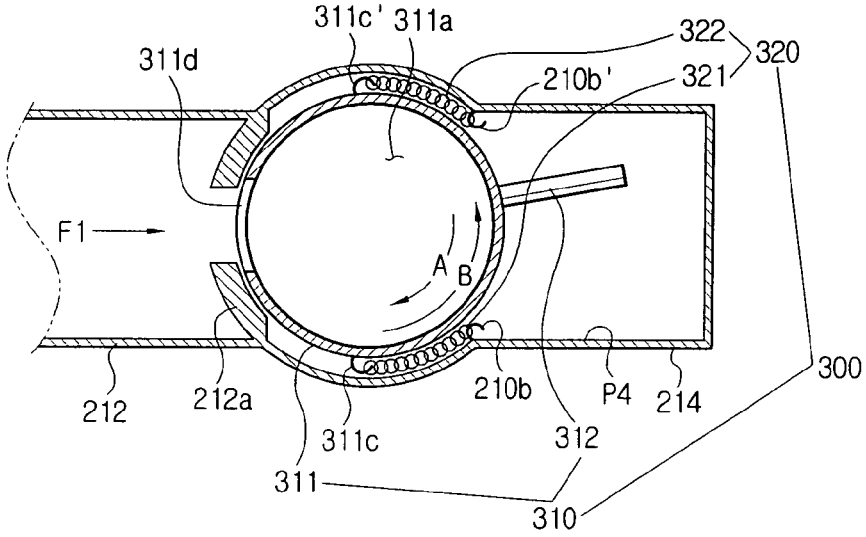
FIG. 4 is a sectional view of FIG. 2 cut away along a line IV-IV.
Figure 5:
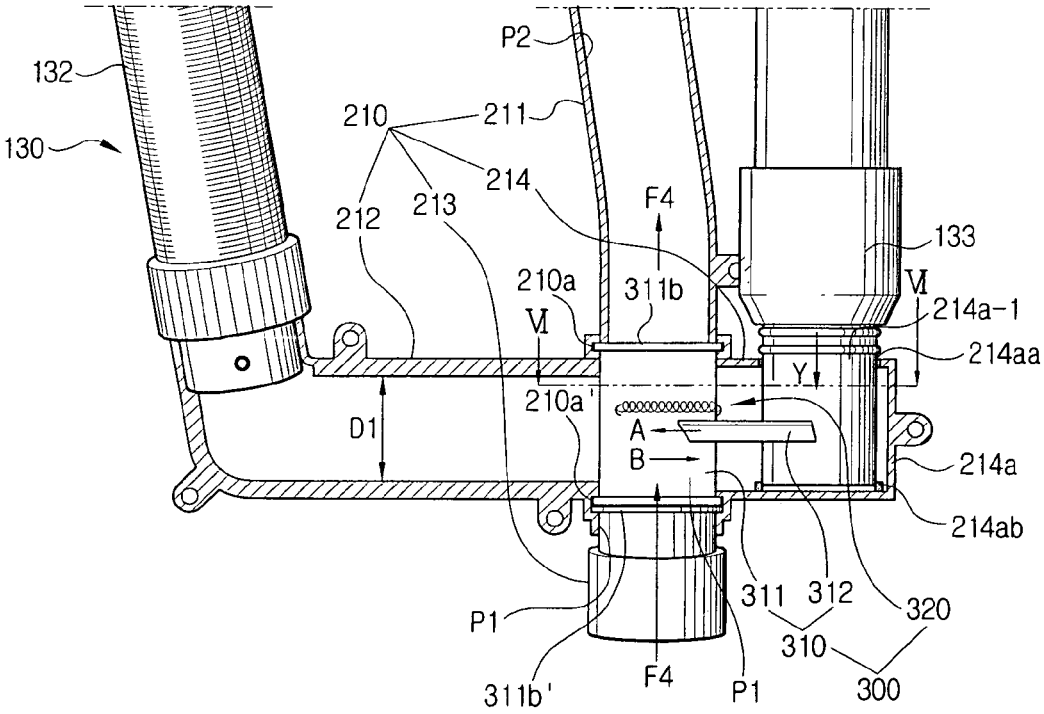
FIG. 5 is a partially sectioned view of an air path in which a valve member of the path-conversion valve assembly is disposed in a second position.
Figure 6:
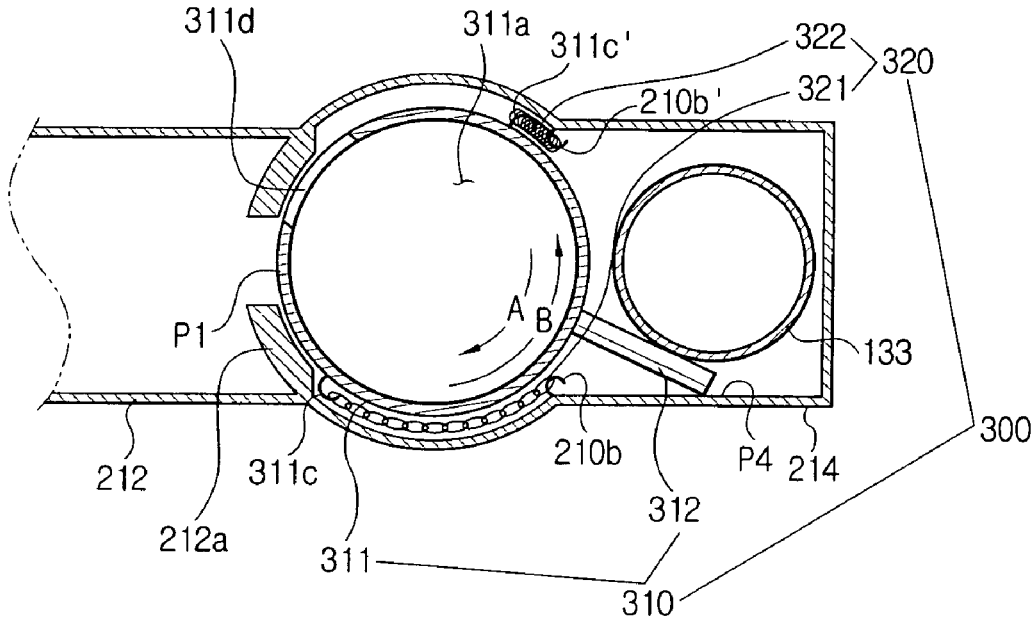
FIG. 6 is a sectional view of FIG. 5 cut away along a line VI-VI.

The duct part 311 comprises first and second projections 311*b* and 311*b*' so that the valve member 310 is able to rotate to a first position as shown in FIGS. 2 and 4 and a second position as shown in FIGS. 5 and 6. More specifically, the first projection 311*b* is disposed at an upper part of the duct part 311 while the second projection 311*b*' is protruded along an outer circumference P1 of a lower part of the duct part 311.

Projection grooves 210*a* and 210*a*' are formed at the air path 210 (FIG. 2) so that the projections 311*b* and 311*b*' are inserted and rotated therein. More specifically, a first projection groove 210*a* is formed by a predetermined depth on an inner circumference of the first duct 211 for insertion of the first projection 311*b*, and a second projection insertion groove 210*a*' is formed by a predetermined depth on an inner circumference of the third duct 213 for insertion of the second projection 311*b*'. By inserting the projections 311*b* and 311*b*' into the projection grooves 210*a* and 210*a*', the valve member 310 can be rotated in the directions of arrows A or B.

Figure 3A:
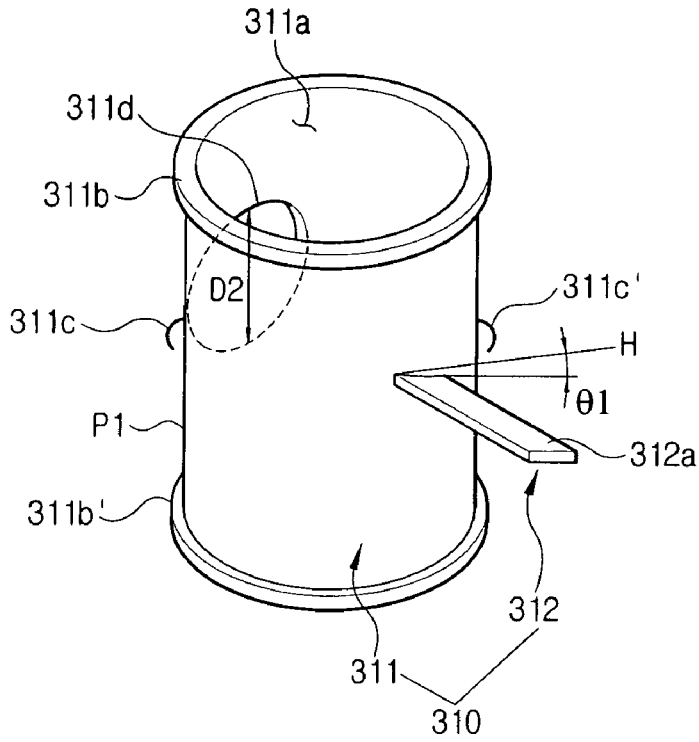
FIGS. 3A and 3B are a perspective view and a plane view, respectively, showing the valve member of FIG. 2.
Figure 3B:
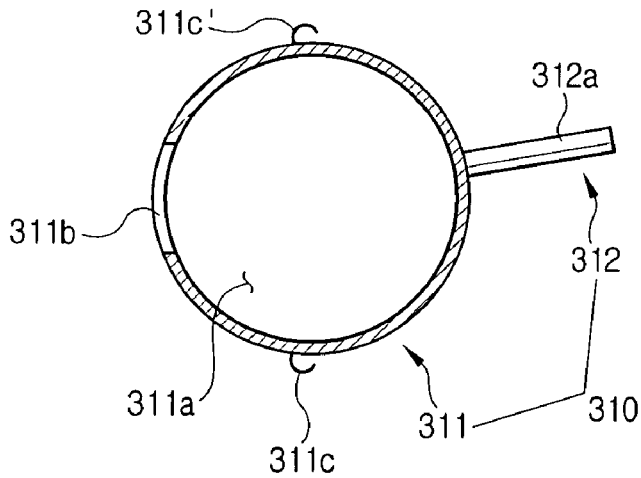

Referring to FIGS. 2, 3A and 3B, a passage 311*a* allowing air to flow therethrough is formed in the duct part 311. Through passage 311*a*, the suction force of the vacuum source 121 (FIG. 1) connected with the first duct 211 can be transmitted to the brush assembly 120 which is in connection with the third duct 213 all the time, regardless of rotation of the valve member 310 in direction A or B.

An opening 311*d* is formed on the outer circumference P1 of the duct part 311. A diameter D2 of the opening 311*d* is smaller than a diameter D1 of the second duct 212. The opening 311*d* selectively brings the first and the second ducts 211 and 212 into fluid communication with each other. For this purpose, the air path 210 includes a screen 212*a* (FIG. 4) in front of the opening 311*d*.

The opening 311*d* directs air into the second duct 212 only when the valve member 310 is disposed in the first position as shown in FIG. 4, so that the suction force of the vacuum source 121 (FIG. 1) connected with the first duct 211 can be transmitted through the opening 311*d* to the hose 130 connected with the second duct 212.

When the valve member 310 is disposed in the second position as shown in FIG. 6, the opening 311*d* does not direct air into the second duct 212; instead, the outer circumference P1 of the duct part 311 blocks the second duct 212. Therefore, the suction force of the vacuum source 121 (FIG. 1) in connection with the first duct 211 cannot be transmitted to the hose 130 through the second duct 212.

The duct part 311 includes first hook parts 311*c* and 311*c*' for holding the resilient member 320 (FIG. 4) on the outer circumference P1 thereof. The first hook parts 311*c* and 311*c*' comprise a first left hook 311*c* and a first right hook 311*c*' symmetrically disposed on the outer circumference P1.

Corresponding to the first hook parts 311*c* and 311*c*', second hook parts 210*b* and 210*b*' (FIG. 4) are formed on an inner circumference P4 of the fourth duct 214 (FIG. 4) in the air path 210. The second hook parts 210*b* and 210*b*' comprises a second left hook 210*b* and a second right hook 210*b*' symmetrically disposed on the inner circumference P4 of the fourth duct 214 (FIG. 4).

The protrusion part 312 is slantingly formed on the outer circumference P1 of the duct part 311. As the hose nozzle 133 (FIG. 5) is inserted in the socket 214*a* (FIG. 5) of the fourth duct 214 in an arrowed direction Y, the protrusion part 312 is pressed by the hose nozzle 133 (FIG. 5).

Since the protrusion part 312 is slanted by a predetermined angle θ1 with respect to a horizon H, the hose nozzle 133 (FIG. 5), while sliding down on a slope 312*a* of the protrusion part 312, presses against protrusion part 312.

Referring to FIG. 4, when the valve member 310 rotates in a certain direction, the resilient member 320 resiliently presses the valve member 310 in the opposite direction. The resilient member 320 comprises a first resilient member 321 and a second resilient member 322 implemented, for example, by a tension spring. The first resilient member 321 extends between the first left hook 311*c* at one end and the second left hook 210*b* at the other end. The second resilient member 322 extends between first right hook 311*c*' at one end and second right hook 210*b*' at the other end. When the valve member 310 rotates in direction A, the first and the second resilient members 321 and 322 resiliently press the valve member 310 in direction B. In contrast, when the valve member 310 rotates in direction B, the first and the second resilient members 321 and 322 resiliently press the valve member 310 in direction A.

One of the first and the second resilient members 321 and 322 may be omitted; however, it is preferable to use both the first and the second resilient members 321 and 322 for more stable operation. Additionally, the first and the second resilient members 321 and 322 can be implemented by any other resilient material instead of the tension spring shown by way of example.

Hereinbelow, the operation of the path-conversion valve assembly according to various exemplary operation modes will be described.

Referring to FIGS. 2 and 4, an exemplary operation of the path-conversion valve assembly in the hose mode for cleaning an irregular surface will now be described.

When the hose nozzle 133 is separated from the socket 214*a* in the direction of arrow X, the hose nozzle 133 no longer presses against the protrusion part 312 of the valve member 310. Here, the first resilient member 321 and the second resilient member 322 respectively, extended and compressed as shown in FIG. 6, return to their initial positions as shown in FIG. 4, thereby rotating the valve member 310 in direction B. Accordingly, the valve member 310 is rotated from the second position as shown in FIG. 6 to the first position as shown in FIG. 4.

Here, the opening 311*d* connects the second duct 212 and therefore, the suction force of the vacuum source 121 (FIG. 1) in connection with the first duct 211 is transmitted to the hose 130 through the opening 311*d*. Also, the suction force of the vacuum source 121 is transmitted to the brush assembly 120 (FIG. 1) in connection with the third duct 212 through the passage 311*a* (FIG. 3A) of the valve member 310. As a result, the suction force of the vacuum source 121 is transmitted to the hose 130 and the brush assembly 120 (FIG. 1) simultaneously. Therefore, dust drawn in through the second duct 212 in the direction of arrow F1 and dust drawn in through the third duct 213 in the direction of arrow F2 converge and pass through the first duct 211 in an arrowed direction F3 for collection in the dust receptacle (not shown).

Referring to FIGS. 5 and 6, an exemplary operation of the path-conversion valve assembly in a brush mode for cleaning an even surface such as floor will now be described.

When the hose nozzle 133 is inserted into the socket 214*a* of the fourth duct 214 in the arrowed direction Y, the hose nozzle 133 presses against protrusion part 312 of the valve member 310. Therefore, the valve member 310 is rotated, in direction A, from the first position as shown in FIG. 4 to the second position as shown in FIG. 6. Therefore, the outer circumference P1 of the duct part 311 blocks the second duct 212 so that the suction force of the vacuum source 121 cannot be transmitted to the second duct 212.

Consequently, the suction force of the vacuum source 121 in connection with the first duct 211 is transmitted only to the brush assembly 120 through the passage 311*a* (FIG. 3A). Therefore, dust drawn in through the third duct 213 in an arrowed direction F4 is collected in the dust receptacle (not shown).

As can be appreciated from the above description of the path-conversion valve assembly of a vacuum cleaner, in an embodiment, the air path can be converted by simply connecting and separating the hose nozzle with respect to the socket.

In addition, since the path-conversion valve assembly has a simple structure comprising the valve member and the resilient member, manufacture and maintenance thereof are easy and economical.

While the invention has been shown and described with reference to certain embodiments thereof, it will be understood by those skilled in the art that various changes in form and details may be made therein without departing from the spirit and scope of the invention as defined by the appended claims.

What is claimed is:

1. A path-conversion valve assembly for a vacuum cleaner, comprising:

a tubular valve member rotatably disposed in an air path formed in a vacuum cleaner, the vacuum cleaner having a socket for receiving a hose nozzle and the valve member having a passage that remains unobstructed at all times and places a vacuum source in fluid communication with an air inlet of a suction brush, said valve member further having a protrusion part that extends slantingly from an outer circumference of the valve member; and a resilient member mounted in the air path to resiliently press the rotating valve member in a first direction, wherein the valve member rotates in a second direction opposite the first direction in response to insertion of the hose nozzle into the socket and the hose nozzle presses against the protrusion part of the valve member.

2. The path-conversion valve assembly of claim 1, comprising:

a first hook part formed at the valve member to catch one side of the resilient member; and a second hook part formed at the air path to catch the other side of the resilient member.

3. The path-conversion valve assembly of claim 1, wherein the valve member includes a projection, and the air path includes a projection groove for insertion of the projection.

4. A path-conversion valve assembly for a vacuum cleaner, comprising:

a valve member rotatably disposed at an intersection of first, second, third, and fourth ducts in the vacuum cleaner, the first duct being in fluid communication with a vacuum source for generating a suction force, the second duct being in fluid communication with a hose connector, the third duct being in fluid communication with an air inlet of a brush assembly, the fourth duct being configured to receive a hose nozzle, and the valve member having a passage that remains unobstructed at all times and places the first duct in fluid communication with the third duct and an opening that places the first duct in fluid communication with the second duct when the valve member is rotated to a first position, said valve member further having a protrusion part that extends slantingly from an outer circumference of the valve member; and a resilient member applying a rotating force to the valve member in a direction toward the first position and away from a second position, wherein the valve member rotates from the first position to the second position in response to insertion of the hose nozzle into the fourth duct and the hose nozzle presses against the protrusion part of the valve member.

5. The path-conversion valve assembly of claim 4, wherein the valve member is rotated from the second position to the first position by the resilient member upon separation of the hose nozzle from the fourth duct and thereby brings the first and the second ducts into fluid communication with each other.

6. The path-conversion valve assembly of claim 1, further comprising a second resilient member attached to a side of the valve member.

* * * * *

UNITED STATES PATENT AND TRADEMARK OFFICE

CERTIFICATE OF CORRECTION

PATENT NO. : 7,996,954 B2
APPLICATION NO. : 11/199173
DATED : August 16, 2011
INVENTOR(S) : Dong-Yun Lee et al.

It is certified that error appears in the above-identified patent and that said Letters Patent is hereby corrected as shown below:

On the Title Page, under "(73) Assignee", column 1, line 5, change: "Samsung Gwangju Electronics Co., Ltd." to -- Samsung Electronics Co., Ltd. --

Signed and Sealed this
Twenty-eighth Day of January, 2014

Michelle K. Lee

Michelle K. Lee
*Deputy Director of the United States Patent and Trademark Office*